US007597276B2

(12) United States Patent
Hawkins

(10) Patent No.: US 7,597,276 B2
(45) Date of Patent: Oct. 6, 2009

(54) ULTRA LOW FLOW SPRAY HEAD

(75) Inventor: Stanley Hawkins, Visalia, CA (US)

(73) Assignee: Jain Irrigation Inc, Fresno, CA (US)

( * ) Notice: Subject to any disclaimer, the term of this patent is extended or adjusted under 35 U.S.C. 154(b) by 368 days.

(21) Appl. No.: 11/279,106

(22) Filed: Apr. 9, 2006

(65) Prior Publication Data

US 2007/0246572 A1 Oct. 25, 2007

(51) Int. Cl.
*B05B 1/30* (2006.01)

(52) U.S. Cl. ..... 239/533.13; 239/518; 239/522; 239/523; 239/542; 239/570; 239/589; 239/602

(58) Field of Classification Search ..... 239/11, 239/109–113, 396, 518, 520, 523, 542, 570, 239/601, DIG. 12, DIG. 19, 512–515, 519, 239/522, 533.13, 589, 590.5, 592, 595, 602
See application file for complete search history.

(56) References Cited

U.S. PATENT DOCUMENTS 4,095,745 A 6/1978 Christy et al.
4,113,180 A 9/1978 Christy et al.
4,128,206 A 12/1978 Bintner
4,130,247 A * 12/1978 Healy ..... 239/523
4,195,782 A 4/1980 Troup
4,350,300 A 9/1982 Vikre
4,364,519 A 12/1982 Kreitzberg
4,380,318 A 4/1983 Curry
4,401,273 A 8/1983 Olson
4,492,339 A 1/1985 Kreitzberg
4,735,361 A 4/1988 Wallace
4,754,925 A 7/1988 Rubinstein
4,796,811 A 1/1989 Davisson
4,846,406 A 7/1989 Christy
4,869,432 A 9/1989 Christy
4,909,441 A 3/1990 Christy
4,955,539 A 9/1990 Ruttenberg
5,158,231 A 10/1992 Christen et al.
5,192,024 A 3/1993 Blee
5,232,157 A 8/1993 Laffrey
5,314,116 A 5/1994 Krauth et al.
5,435,490 A 7/1995 Machut
5,553,786 A 9/1996 Israel (Continued)

*Primary Examiner*—Len Tran
*Assistant Examiner*—Jason J Boeckmann
(74) *Attorney, Agent, or Firm*—Law Office of Ken Dallara; Ken Dallara

(57) ABSTRACT

An ultra low volume pressure independent spray head is disclosed whereby low flow characteristics of point source devices can be applied to larger wetted areas. Device uses elastomeric flow control where the emission channel is large enough to purge particulate matter from it's channels and the spray head has large enough orifices to allow the particulate to pass unimpeded through the discharge arena. This device is designed to utilize flow rates of less than 2 gallons per hour and can compensate for pressures between 10 and 60 pounds per square inch. Construction of this device is through the use of polymers, but other materials can be used as the design is such as to allow for a large variety of applications. This device can be used in the agricultural or horticultural application and is adapted for use in vineyards and can be used singularly or in multiple head arrangements. Design of inlet portion allows for use with flexible or rigid water supply means.

2 Claims, 5 Drawing Sheets

U.S. PATENT DOCUMENTS 5,727,733 A 3/1998 Ruttenberg
6,223,999 B1 5/2001 Lemelshtrich et al.
6,691,739 B2 2/2004 Rosenberg
6,764,029 B2 7/2004 Rosenberg

* cited by examiner

Purge Mode

Pressure Compensating Mode

ULTRA LOW FLOW SPRAY HEAD

CONTINUITY OF PRIOR DISCLOSURE

This invention was first disclosed on May 18, 2005 through Disclosure Document Number 578357 filed with the United States Patent Office as the Ultra Low Flow Pressure Compensating Spray Head.

FIELD OF THE INVENTION

This invention involves the field of ultra low flow spraying devices used in the horticultural and agricultural arenas, though its application in other fields is anticipated. Ultra low flow in this application refers to fluid flows as low as ½ gallon per hour, and the preferred use of this spray head invention is between ½ gallon per hour and 2 gallons per hour.

BACKGROUND OF THE INVENTION

Low flow or micro irrigation is a form of irrigation of plants, row crops, trees and shrubs, where the amount of water delivered to the plant is metered into the range of ½ gallon per hour and as high as 28 gallons per hour for bubbler devices and sprayers, depending on the type of soil, type of plant or tree, and the individual requirements of the plant, such as roses that like to be heavily watered, letting the ground dry out between watering. The average plant can absorb approximately 1 gallon per hour through it's root system and the roots need air to aid in this absorption process. Conventional watering systems, such as hose end devices and conventional lawn sprinklers and bubblers, can deliver more than 125 gallons per hour, causing much waste not only of the actual resource of the water but alters the geology, topography and composition of the soils. Excess water usually runs away from the planting area causing erosion, which carries off the valuable top soil and causes damage to the plants as their roots can become exposed and dry out. Runoff water can also carry with it fertilizers and soil nutrients, which can pollute other areas and rob the plant of its food source. Excess watering also causes the leeching of dissolved salts and minerals from the ground and concentrates them where the runoff is collected, often killing whatever vegetation is present due to the high concentrations of salt and heavy metals. Excess water also creates an economic disadvantage as there exist the actual cost of the wasted water and the cost of the power to pump the water from it's source. Many studies support the concept of low volume or micro irrigation for many types of plants and trees, as a benefit to more better plant health and environment, where the returns include better crop yields due to healthier plants and the development of a stable topsoil.

Low volume irrigation is broken down into two main categories; point source devices and wetted area devices. Wetted area devices are most commonly seen as bubblers and sprayers with patterns and sprinklers with rotating or static elements which actually increase the velocity of the water droplets to increase their range. Wetted area devices usually deliver 7 to 28 gallons per hour. Point source devices deliver water to a specific point, such as a dripper, where the amount of water delivered is between ½-4 gallons per hour. A point source device is usually placed along the ground within the dripline of the plant or tree and vary in number depending on the amount of water is needed. Wetted area devices are used on ground covers and between trees to encourage root spread of the tree to the water source.

Topography and climate play a large factor in designing low volume irrigation systems. Hillside applications, especially in the grape growing and citrus growing regions where good land is very valuable and is often not flat, present problems. Point source devices will deliver water only to a specific point limiting coverage and creating runoff as gravity pulls the water away from the plant and may not be able to deliver a sufficient amount of water, and sprinklers will deliver too much water and will cause the erosion effects described supra. Windy conditions also affect micro irrigation when sprinklers and sprayers are used. Due to the size of the droplet produced, which is much smaller than a conventional sprinkler due to the decreased volume of water, wind will blow the spray away from the intended watering area. Usually the spray is directed horizontally along the ground from a device that is placed 1-2 feet above the ground in order to increase the area of the wetted surface. Point source devices are not susceptible to this wind, but may not be able to deliver a sufficient amount of water and will not be able to do so over a wetted area.

Prior art is replete with examples of low volume wetted area devices. In the agricultural and large horticultural applications, most water supply conduits are required to carry vast amounts of water to many locations, usually far from the source of the water, and then there must exist some medium to reduce the large volume of water present to a low volume. There are three main methods of reducing this volume; flow restriction, reduction of aperture size, and intermittent watering.

Flow restriction device are either static or dynamic. A dynamic flow restriction device is detailed in U.S. Pat. No. 4,084,749 to Drori issued on Apr. 18, 1978. Here the volume of water is reduced through the use of a labyrinth which retards the flow of the water. An embodiment to Drori is a spring-biased pressure sensing member whose movement decreases flow in response to pressure differentials. Unfortunately, for this device to function in the range of ½ gallon per hour, the tolerance of manufacturing variables in the many pieces present would be impractical for high volume manufacturing. Also this device would not be able to able to internally cleanse itself as there are many internal corners and narrow passageways where dirt and dissolved solids would accumulate and cause failure. Also due to the friction created by the many turns the water must go through, there is a substantial pressure drop. Other dynamic flow control devices are present in the pressure compensating drippers manufactured by many irrigation companies around the world, where flow rates as low as ½ gallon per hour are common. These drippers are made of polymer materials where a labyrinth is integral to the polymer material which is encased in a rigid body or these drippers have a rigid labyrinth body over which a silicone disk is placed. In either instance, the disk or polymer flexes and seals against the rigid body reducing the amount of flow allowed to pass. These devices however reduce the amount of flow while also reducing the pressure through friction as well, so that the resulting flow is delivered at a de minims amount of pressure. Due to this low pressure and the small openings of the labyrinth, these devices are often prone to clogging through particle and mineral deposits.

The Static flow controls are flexible usually circular pieces that contain a passageway centered therein, said passageway containing beveled sides, whereby the passageway on the top of the flow control, the side facing the water supply, will have a diameter smaller than the diameter of the passageway on the back of the flow control. This flow control flexes causing the passageway to constrict thereby reducing the flow past the flow control device. The size of the hole dictates the amount of flow restricted. This device is marketed by such irrigation companies such as Raindrip Inc. as Flow Control Device Part Number R425C and Hendrickson Bros Inc, Part Number HM-50G, and is disclosed in U.S. Pat. No. 4,492,339 issued to Kreitzberg on Jan. 8, 1985. These devices function well at higher flow volumes but are limited to those flows approximately 6 gallons per hour and above as the size of the hole necessary to create a lower flow causes problems in the manufacturability and functionality of the flow control as well as presenting issues with cleaning and clogging. In this application, which relies on a high velocity stream of fluid, a flow control disk of correct cross-sectional orifice size would not allow for enough velocity.

The restriction of the nozzle size is the principle of the nozzle placed on the garden hose. Water pushed through a smaller orifice increases it velocity or pressure following Boyle's Law. Products that regulate flow through a fixed orifice include one's ordinary lawn sprinklers. By decreasing the size of the orifice, the amount of water is decreased as water is not capable of decreasing in volume as pressure is increased. Thus, only a specific amount of water can go through an orifice irrespective of the amount of pressure behind the water. This also causes a pressure differential between the two sides of the orifice. The restriction of nozzle size is applicable to high flow devices such as lawn sprinklers which are delivering 60-90 gallons per hour or more, but the size of the orifice required to create flows necessary for low volume irrigation is very small. A 0.060" orifice is still capable of delivering up to 28 gallons per hour at 25 psi, To reach the level of this invention, the size of the orifice would need to be approximately 0.006" to achieve an output of ½ gallon per hour. An orifice this small will easily be obstructed by the dissolved solids and impurities present in the water, as filtration would generally not be able to remove such small particles. Also after the water is turned off, calcium and other hard minerals are left on the surface of the orifice through evaporation, clogging the nozzle prior to the next operation.

Intermittent watering involves the principle of a uniform discharge of water that is accomplished at predetermined intervals of time. U.S. Pat. Nos. 5,727,733 and 4,955,539 to Ruttenberg and U.S. Pat. No. 5,314,116 to Krauth et al, typify the intermittent style of sprinkler. These devices convert a low flow of water into a high flow of water by using short bursts of water frequently over a period of time, causing a lower volume of water to be expelled over a greater wetted area. It is a basic principle that when a high pressure stream of water is diverted, a smaller water droplet is formed, than if a lower pressure stream of water is diverted. It is also basic in principle that a smaller droplet of water will not travel as far as a larger droplet of water when subjected to a similar pressure that propels them. Water droplets tend to rapidly break down into smaller and smaller droplets as the pressure increases, causing an atomization of the water droplets at higher pressures. It is also basic in principle that a lower flow rate traveling through a particular orifice will travel a shorter distant than a high flow rate. Simply turning the garden faucet from ¼ open to fully open verifies this principle. The wetted area of a 10 gallon per hour sprinkler is smaller than that of a 20 gallon per hour sprinkler normally. And the droplet size of the 10 gallon is smaller as well. These devices work by capturing a flow of water into an elastic casing which expels the water after it reaches a specific pressure. As the water is expelled, the retraction of the elastic casing increases the pressure, hurling the ejected water out of the sprinkler. In this case, if there was a 20 gallon per hour flow input into the device, and the device only ejected the water every 2 seconds and took 4 seconds to fill the casing for the next ejection, than only 10 gallons per hour would be ejected. But because the amount of water ejected would be equivalent of 20 gallons per hour the size of the orifice and the size of the droplet is equivalent to the 20 gallons per hour as well as the wetted area. The user receives the benefit of a larger droplet size which is less effected by climatic conditions. Unfortunately, for these devices to be able to eject large volumes of water, there orifice size must be larger and that invites insects to enter and block the passages. Also due to the need to develop the casing, these products are difficult to manufacture and expensive. U.S. Pat. No. 6,691,739 to Rosenberg issued on Feb. 17, 2004 uses mechanical means to hold the water until a higher pressure is created. This device as designed will not function completely at low flow rates, and due to the narrow size of the passages required for low flow rate, this device is prone to failure with the accumulation of dissolved solids in the water and requires a complex disassembly to clean the device.

Inherent to the functioning of this invention is the elastomeric flow control valve that provides a constant low volume stream of water throughout a pressure gradient. This flow control must be able to adapt to low pressure as well as higher pressure application and provide a constant flow of water. As described supra, reduction of the flow of water must be accomplished in such a manner whereby hard, static surfaces are avoided to prevent clogging and mis-application of the water. This elastomeric flow control valve must be capable of purging itself at low pressures which will discharge any impediments out of it's flow passages during this purging process. This purging must be accompanied with a sufficiently large diameter orifice sized to eliminate those impediments that would clog the flow paths of the device. This self-cleaning action is desirable as filtration in large field applications are not capable of trapping such small sediment that would otherwise clog static devices. The elastomeric flow control is capable of possessing a larger flow path than would be found in static flow control devices as this flow path reduces as the pressure increases. The flow restriction side of this device is shaped as a bill of a duck with a slot embossed into the interior of one side of the duckbill. As pressure increases, the flow path is restricted and the fluid that is allowed to pass through this slot is in the character of a high velocity stream of fluid, jetting out of the flow control device at the desired amount of flow. There is also a purging action as at starting pressure the arching flow path is large allowing for trapped particles to be flushed through the large orifice and in the presence of higher pressures, those above 2-3 psi, the flow path flexes due to its construction containing elastrometric materials, and reduces the amount of water flowing into the larger orifice at the regulated amount. The major benefit of this style of flow control device is that the amount of flow is limited by the flexing of the device but does not completely reduce the pressure to a minimalist flow. Other manufactures have developed flow regulators that use these elastomeric flow control devices in higher flow rates, such as the Acu-Flo device by Wade Rain Micro-irrigation which functions in-line with feeder tubing and low volume sprinklers. These elastomeric flow control devices have been used at the junction of the supply tubing and the feeder line such as disclosed in U.S. Pat. No. 4,869,432 issued to Christy on Sep. 26, 1989. Both of these applications use elastomeric flow control devices but the flow rates of these devices is rated at 6 gallons per hour and higher and these devices have wetted areas of 6 feet of diameter and greater. Emphasis has been on low volumes over increasingly larger wetted areas. This invention uses lower flow rates than previously had been used in sprinkler applications. Another usage of this elastomeric flow control device has been in lower volume point source devices. U.S. Pat. No. 4,113,180 issued to Christy et al on Sep. 12, 1978 discloses the use of this style of device but teaches it's use in low flow applications in point source devices where the pressure is reduced to a deminimus amount due to a pooling of the output of the elastomeric control valve.

Prior art has only used the flow control characteristics of this valve. Prior art has not used the jetting characteristic of the elastomeric flow control valve. A characteristic of this valve is that the flow path is restricted thus small amounts of flow are expelled at high velocities as the pressure on the input side is much greater than is present at the outlet side. This invention uses this jet of water and changes it's direction gently to produce the desired results. This has not been accomplished nor taught by the prior art. It would be advantageous to develop a spray head that incorporates a flow control device that is integral to the spray head itself. This would reduce the extra tubing, costs and labor associated with installation flow controls separate from the spray heads.

It would be advantageous to have very low volumes of water to be sprayed over a small wetted area, and the current devices are not capable of performing such a need. The prior art either decreases the flow rate by also decreasing the pressure or does not decrease the flow rate low enough with sufficient pressures.

The present invention is a device that when attached to a pressurized conduit of fluid is capable of regulating the amount of fluid flow irrespective of reasonable pressure gradients and deliver that fluid at a constant low delivery rate of less than 2 gallons per hour over a small contiguous wetted area.

It is an object of the present invention to incorporate into a single device the benefits of point source delivery of water at a delivery rate of less than 2 gallon per hour with an increased amount of wetted area, up to 8 square feet preferably at ½ of a gallon per hour.

It is an object of the present invention to be able to deliver fluid at a very low rate consistently through varying pressure gradients while maintaining the ability of self-cleanability and containing sufficiently sized orifices that can accommodate large particulate matter.

It is an object of this present invention to be able to deliver this fluid in different patterns of distribution at low flow rates through varying pressure gradients while maintaining an uniform spray pattern with uniform size of water droplets.

It is an object of this invention to be able to adapt this technology into a variety of situations whereby this invention is able to be used for point source irrigation applications and other agricultural applications such as frost protection, bedding plants or plant or evaporative cooling.

BRIEF DESCRIPTION OF THE DRAWINGS

FIGS. 2-1 and 2-2. FIG. 2-2 is a close-up of the vertical cross-section from FIG. 2-1 highlighting the departure plane.

DETAILED DESCRIPTION OF THE INVENTION

The present invention will be detailed in relation to the aforementioned drawings. All disclosure is representative of the best mode of practicing this invention but that it is assumed that those skilled in the art will be able to practice this invention in other fields of application, nor does this disclosure limit the construction of this invention to the parts herein disclosed. Applicant recognizes that development of future inventions may lead to better parts than those disclosed, but the intent of this application is to show the best available parts currently available by their fit, form and function to their exclusive use by this application.

Figure 1:
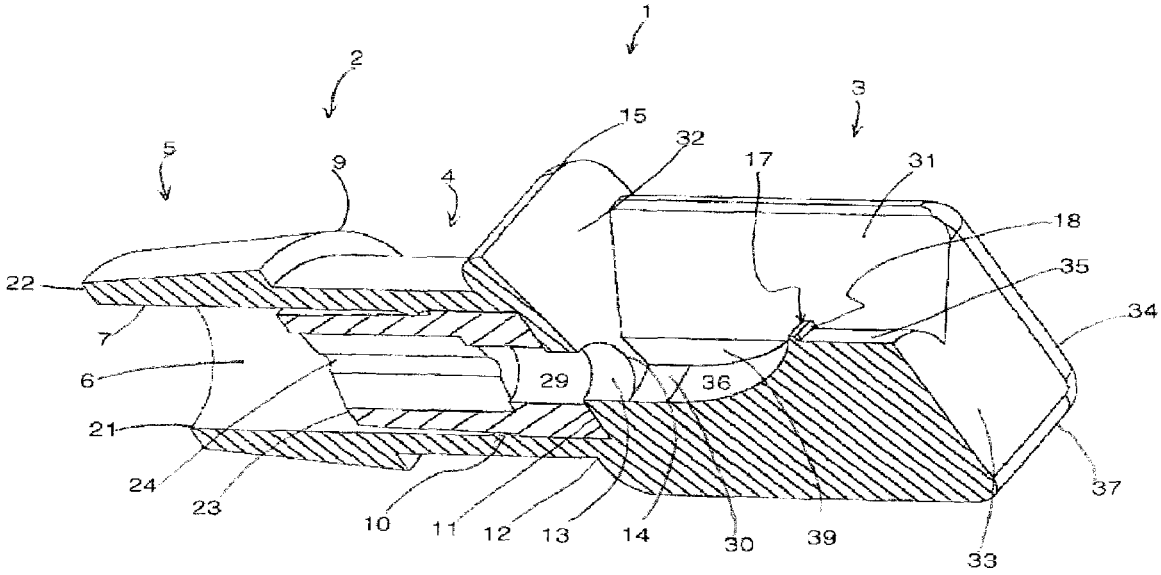
In FIG. 1, a cross-sectional view of this invention is shown as it applies to a strip style of a wetted pattern.

Referring to FIG. 1, whose inlet portion which is representative of the inlet sections of all style of spray heads in the present invention, Spray head 1 is shown in a cross sectional view. Head 1 is broken down into two main sections, inlet portion 2 and dispersement portion 3. Inlet 2 is the interface portion of the Head 1, whereby Head 1 is connected to the water source and dispersement portion 3 is shaped to perform the type and size of wetted area required by the application.

Figure 3:
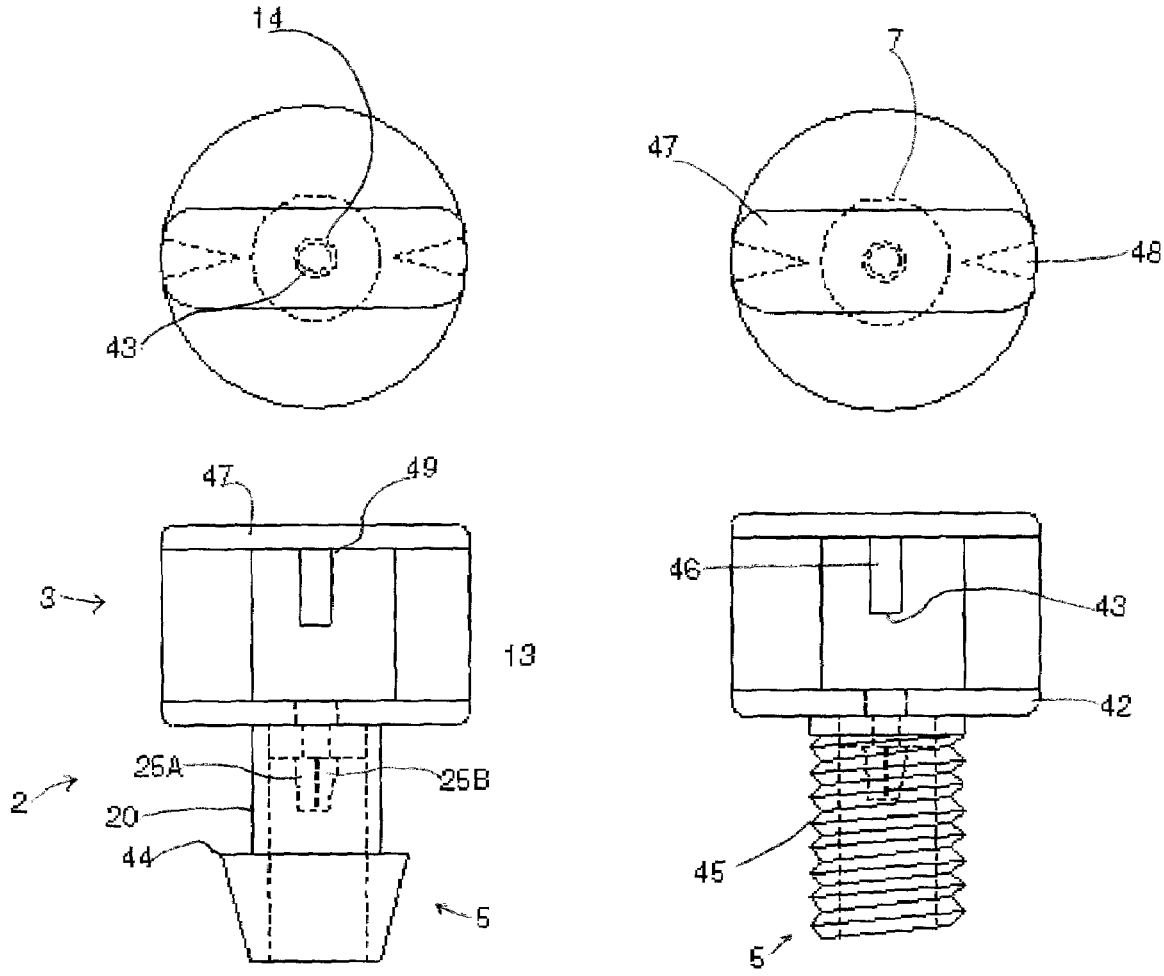
In FIG. 3, alternate style of spray application or wetted area design are shown. Note the use of alternative attachment means.

Inlet 2 has a smooth, typically cylindrical, hollow bore 4 defined by outer wall 20 and inner wall 7, which defines inner bore 6, having a terminus at each end. At exterior terminus 21, attachment means 5 is located along outer wall 20 at terminus end 21. In this best mode for the invention, a conventional barb is used. This style of spray head applications will be used mainly in conjunction with varying fluid supply means. Such fluid supply means include polyethylene supply tubing of varying outer diameters and wall thicknesses and rigid polyvinylchloride tubing. Embodiments of this invention disclose the use of other styles of attachments means include external protruding threads of varying design, smooth or knurled tapered bores and compression style of attachment means. Threads, usually of the size and density described as 10-24 or 10-32 are common in the industry as well as American Standard Buttress Threads with extremely large pitch. The leading edge 22 of terminus 21 can be perpendicular to bore 4 as shown. An embodiment of this invention is created using an acute angle forming a tapered or self-piercing inlet portion to facilitate an easier insertion of attachment means 5 into the fluid supply means as seen in FIG. 3. In this application, attachment means 5 has outer gripping surface 8 sloped at an acute angle emanating from leading edge 22 to attachment means shoulder 9. Landing area 20 is the distance between shoulder 9 and exterior bore end 12 is dependent upon attachment means used. In this example of a barbed connector, a sufficient landing area 20 is used that is greater than the wall thickness of the polyethylene fluid supply means. In other applications, such as external threads, landing area 20 would constitute a minimal amount of area. Inner portion of cylindrical hollow bore 6 terminates interiorly at buttress 11, which is not necessarily congruent with exterior bore end 12. Buttress 11 contains orifice 13 which has an interior side 23 and exit side 14. In this present invention shown in FIG. 1, orifice 13 has a smooth bore and whose centerline is congruent with the centerline of inner bore 6. Captive ring 10 is located at a point along inner bore 6 whereby the flow control body 26 of elastomeric flow control valve 23 is held captive between captive ring 10 and buttress 11. Captive ring 10 forces a contact fit between buttress 11 and face 27 of flow control body 26 and keeps orifice 13 and exit port 28 in axial alignment. In this invention, Captive ring 10 is a positive detent protruding from the surface of bore 6, but does not limited itself, as control valve 23 could have possessed an gripping ring on it's body to interface with a negative detent on captive ring 10 which would be submersed into the wall of bore 6. Any device or operation, such as swagging, which creates a positive stop to prevent disengagement of control valve 23 from contact with buttress 11 would be acceptable and is held within the spirit of this disclosure. It should be noted that orifice 13 has a diameter that is smaller than the diameter of exit port 28, as this prevents the collapse of control valve 23 and possible intrusion of control valve past the interior shoulder 23 of orifice 13.

Figure 5:
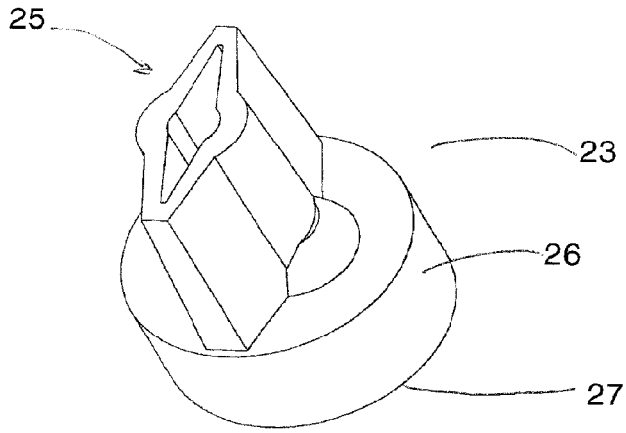
In FIG. 5, the elastomeric control valve is viewed from the anterior end showing the flexing of the flexible walls to limit the flow path.
Figure 5:
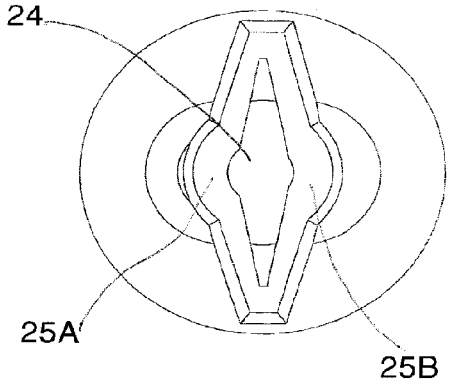
Figure 5:
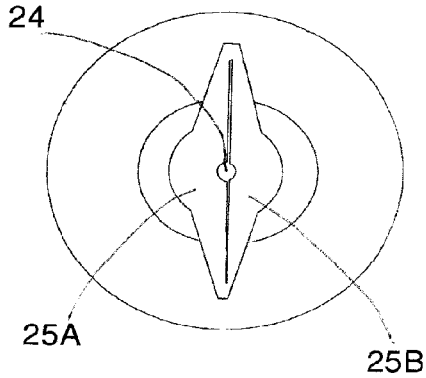

Elastomeric flow control device 23 generally has an inlet area 25 which contains an emission slot 24 in axial alignment with bore of accumulator 29 and subsequently exit port 28. FIG. 5 details the device 23 in isometric and anterior views. Inlet area 25 is comprised of two highly flexible duckbill shaped walls 25A and 25B, whereby emission slot 24 is embossed or countersunk into one of the duckbill shaped walls. FIG. 5 details the purge mode as pressures below 2 psi allow for maximum aperture between the walls 25A and 25B, and the pressure compensating mode over 2 psi, as walls 25A and 25B reduce the size of the aperture in linear relationship to the external pressure present. As pressure increases above 2 psi, walls 25A and 25B are compressed by the pressure whereby the emission slot 24 is reduced in cross-sectional area, thereby maintaining a constant flow from emission slot 24 into accumulator 29 through varying pressure gradients. Fluids escaping emission slot 24 do so at high velocities due in part to the high pressure differential between the inlet area 25 and accumulator 29. It is critical for the functioning of this invention that this high velocity stream is maintained and not subjected to any interference. At very low pressures of less than 2 psi, emission slot 24 has a maximum cross-sectional area, allowing any sediment to pass though emission slot 24 through accumulator 29 and exits through exit port 28. This is the self-cleaning or purging action that is enabled when orifices remain at diameters greater than the inlet channel. Rigid flow controls and reduced orifices diameters used to restrict flow can not accomplish this task of purging as the opening small enough to restrict flow will be too small to pass sediment thereby clogging the opening.

Figure 2:
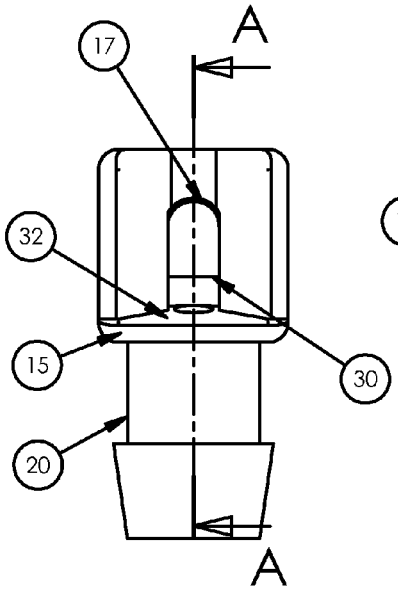
In FIG. 2, a frontal elevation is shown along with two detailed vertical cross-sections A-A.
Figures 1, 2:
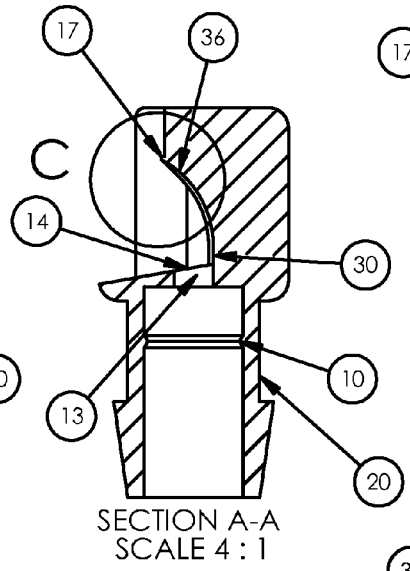
Figure 2:
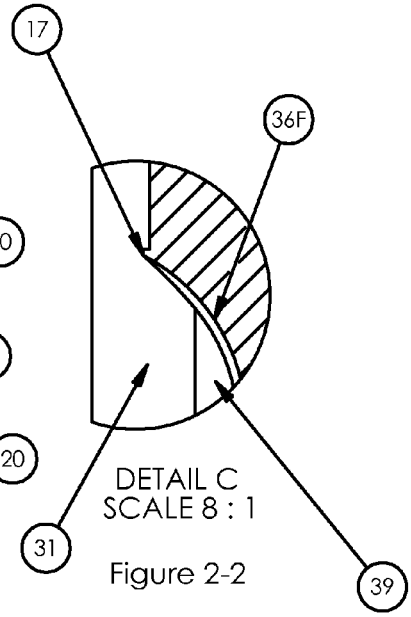
Figure 2A:
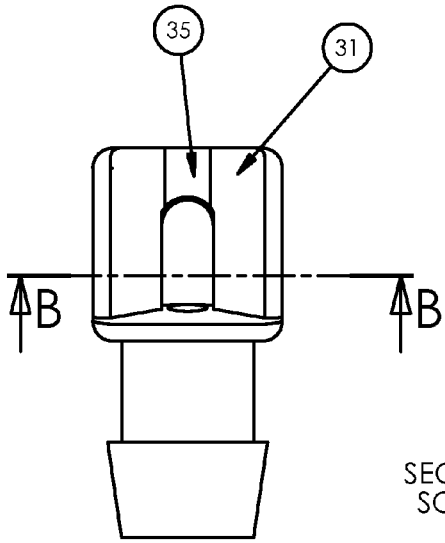
FIG. 2A presents as a frontal elevation with horizontal cross-section B-B along the top edge of offset wall, and FIG. 2A-1 details the view of the dispersion chamber.
Figures 1, 2A:
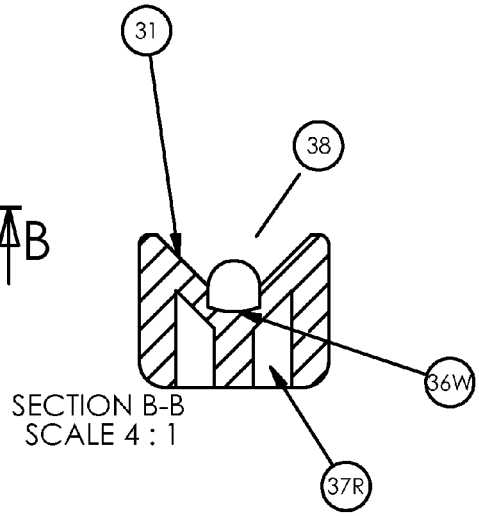

Dispersement portion 3 is defined by a lower wall 32 which is perpendicular to the axis of orifice 13, and contains exit face 14, and a dispersion chamber 38. Dispersion chamber 38 is a 3 sided object with flow director arena 36 defined within the interior portions of two exterior walls 34, and a back wall 37, along common vertices, with all 3 walls terminating at top wall 33. The interior of chamber 38 has sloped walls 31 descending from the apex of exterior walls 34 at an acute angle $\alpha$. Walls 34 along with as defined by angle $\alpha$ create the pattern shaping means such that an increase in angle $\alpha$ will increase the degrees of coverage of the wetted area. Protective stop 35 has a distance descending from top wall 33 into the interior of chamber 38 sufficient to prevent contact of water departure plane 17 by operators of this invention and from contact during assembly, packaging and distribution. Consequentially, the height of exterior wall 34 is such to submerge the director arena 36 as far away from the summit of wall 34 while still maintaining the function of the arena 36. Angle $\alpha$ is not critical for the dispersion of the fluid so long as it does not interfere with the dispersion of the water. All walls are currently shown as solid walls, but manufacturing and mold criterion along with desire to reduce material usage can alter the exterior faces of the walls by using ribs, texturing, relief's, or contours as seen in FIG. 2A section B-B where back wall 37 has reliefs 37R are therein. Design of lower wall 32 can include a 4 sided configuration as shown or any number of sides that facilitate the adaptation of assembly fixtures and tools used in conjunction with the installation of the device in the actual field of use. FIG. 2 details the pattern producing radiused slope 36 and pattern walls 39 along with the critical element of the water departure plane 17. Slope 36 is designed whereby fluid emanating from exit face 14 is tangentially interfered with, causing the fluid to ride along the curved slope rather than meeting the slope along a perpendicular plane. This tangential contact allows for a change in direction without a significant decrease in the pressure or velocity of the fluid that is discharged from the inlet portion. The tangential point of contact is called the focal concussion point 36F, whereby the vertical stream of fluid emanating from exit face 14 tangentially contacts slope 36. A normal sprinkler where water is directed through angles, will reduce the pressure of the water and thus the range of effectiveness of the sprinkler, as water loses pressure each time it has to change direction. In the present invention, the tangential contact with the radiused slope is similar to spacecraft flying tangential to gravitational objects where the spacecraft changes directions along line tangential to the surface or atmosphere of the object. The slope 36 begins at the top edge of offset wall 30 which is farthest from exit face 14 while still allowing for the stream of fluid to tangentially contact along slope 36 at focal point 36F. Water departure plane 17 is critical to this present invention due to the inherent characteristics of water. Water will try to follow the surface of an object, as the surface tension of the water is greater than the cohesion of water to itself this is commonly known as the Coanda Effect. The height of the departure point 17 is such as to use this surface tension of water to direct it towards the surface to be wetted rather than allowing the water to simply continue past the slope along the same path upon which it emanated from the exit face 14. In this invention, the height of the departure plane is 0.030". Departure point 17 is similar to the gravitational pull of objects giving the spacecraft an extra burst of speed due to the relationship between the speed of the spacecraft, gravitational pull of the object and the distance the spacecraft is separated from the object. Here departure point 17 creates the proper distance of contact in order for the water to change direction, in this case a change of 90 degrees from it's initial path, with the minimal amount of pressure loss causing the water to lose surface adhesion with the slope of the device.

FIG. 1 details the relationship for a strip or rectangular wetted pattern but this invention can be used in alternative configurations. It is possible to increase the width component of the wetted pattern by increasing the width component 36W of slope 36 thereby decreasing angle $\alpha$. FIG. 2 shows an embodiment of this invention as width 36W is increased and departure plane 17 is curved. This curvature is concave about the entrance 14 and the degree of concavity is defined by the pattern desired. It is the curvature of departure plane 17 that causes water to directed into the sloped walls 31. This curvature forces the fluid to maintain close contact with itself rather than sloped walls 31 as the angle $\alpha$ is decreased. As width 36W increases and angle $\alpha$ decreases, water will adhere to sloped walls 31 creating a pattern with heavy emphasis on the sides and very little fluid spray in the middle of the pattern. It is this curved departure plane that directs the majority of the fluid away from the sloped walls 31 and into the center of the pattern desired. Angle $\alpha$ can be increased or decreased to produce a particular pattern configuration. It is critical to the functioning of this invention, that distance 30, width 36W, slope 36 and departure plane 17 work in conjunction to provide the pattern desired. It is these 4 components (30,36W, 36 & 17), that when subjected to the jet of fluid emanating from exit face 14, create the spray pattern necessary to accomplish the goal of this spray head. In this invention, a spray pattern of 45-60 degrees is the maximum obtained in this configuration. FIG. 3 shows the adaptation of this invention to a fully circular wetted pattern. Though this pattern is not novel, it is the ultra low volume of water that is being dispersed over this circular wetted area. FIG. 3 also shows details alternatives attachment means 5 coincident to outer wall 20. One view a barbed attachment having a rounded end emanating from leading edge 22 progressing along an acutely angular path toward bore end 12 with barbed termination point 44 extending perpendicular to outer wall 20. Another view shows externally located threads 45 emanating from leading edge 22 circumscribing an angular circular ascent toward bore end 12. Pitch and slope of threads 45 are proscribed by industry standard or need of the user. Dispersement portion 3 for this figure is defines a circular wetted pattern. Inlet 2 containing inner bore 6 with inner wall 7 is similar to aforementioned rectangular pattern and exit side 14 of orifice 13 now located centrally located upon platform 42. Platform 42 is circular in this invention, but other outlines including octangular can be used to facilitate installation or assembly fixturing. Exit side 14 is coincident to the upper surface of platform 42 and creates the last contact point as the fluid leaves the confines of orifice 13 toward dispersement contact post 46. Contact post 46 is inwardly vertically displaced from upper bar 47 toward orifice 13. Contact post 46 is cylindrical in nature is a diameter smaller than the diameter of exit side 14 of orifice 13. The shape and size of contact post 46 is not critical to it's function and other styles are assumed part of the spirit of this invention. Contact post 46 has a central line of axis along its major axis which is coincident with the centerline of orifice 13. Contact post 46 has two ends, a dorsal contact point end 43 and an attachment anterior side 49. Dorsal contact point 43 has a circular shaped and possesses a diameter smaller than the diameter of orifice 13. Length of contact post 46 is defined by the distance between contact point 43 and exit side 14 of orifice 13. Distance between contact point 43 and exit side 14 is such as to perfect the effects on a stream of fluid into a circular pattern of wetting. If contact point 43 is too close to exit side 14 a droplet will form between the two surfaces which will fail to disperse causing an erratic pattern. If contact point 43 is too far from exit side 14, the chance for the fluid stream to be effected either through natural forces such as wind, or though manufacturing tolerances, either case causing the fluid stream not to interface directly onto surface of contact point 43 will occur, causing errors in the wetting pattern. In this invention, a distance of 0.100" was found to be proper. Contact point 43 has a flat surface that is perpendicular to exit side 14 or can be slightly concave or convex to alter dispersement patterns. In this invention a flat surface was used. Upper bar 47 is secured to dispersement portion 3 by supports 48. Triangularly shaped support 48 are shaped to provide the minimal amount of interference with the pattern while maintain sufficient strength to maintain upper bar 47 in proper position above fluid stream.

Figure 4:
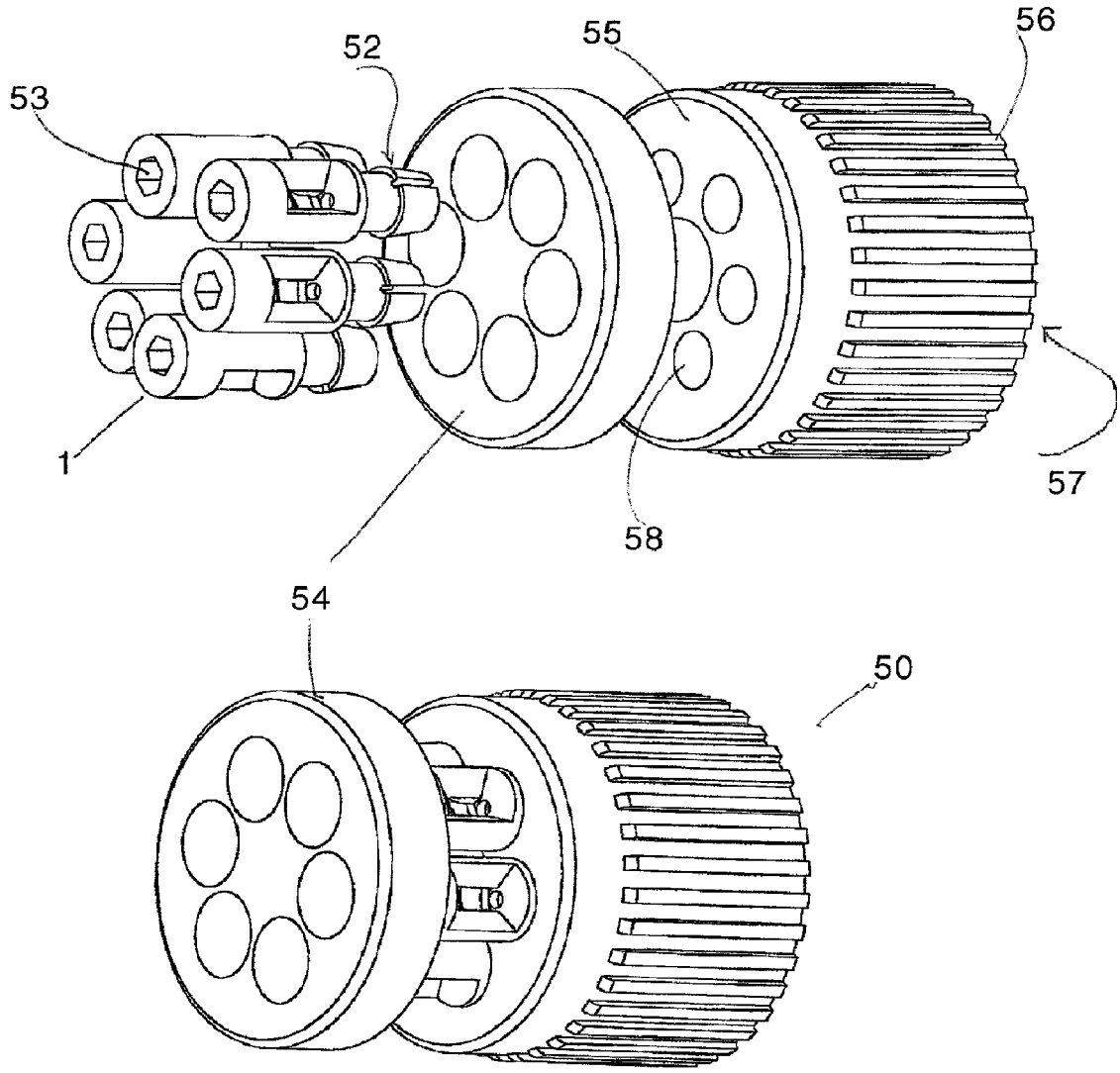
In FIG. 4, an embodiment of the present invention is disclosed as a multiple head arrangement is shown where multiple heads are located on a common base.

In FIG. 4, another embodiment is disclosed. FIG. 4 shows an exploded view and assembled view of a multiple outlet spray device. Multiple units of spray head 1, such a 6 units shown, can be adapted to base 50. In this instance, the base 50 is an dorsal end 57 which contains a female adaptor for ½ inch standard tapered pipe thread with an exterior surface 56 adapted to be gripped by a user, usually with wet hands. Exterior surface is disclosed in a vertically ribbed fashion, but any texturing to the exterior 56 whereby friction is increased would be suitable. Base 50 has an anterior end plate 55 which is adapted for receiving inlet 2 of head 1. Attachment means 5 for this embodiment has a bayonet style of fitting 52, which is similar to the barb style aforementioned but contains vertical slits that allow attachment means 5 to decrease in circumference allowing for insertion into mounting holes 58 in end plate 55, prior to their expansion to their normal circumference after insertion, thereby creating a secure fit which is capable of horizontal rotational but prevents vertical egress. Spray head 1 is adapted with a female pattern 53 along top wall 33. In this embodiment, a hexagonal pattern is used to accommodate a normal Allen type of wrench, whereby the user is able to adjust the output direction of head 1 after it is inserted into end plate 55. Top plate 54 secures head 1 into place, providing a barrier protecting the spray heads from accidental contact and damage.

Thus it can be readily apparent to those skilled in the art, that this invention accomplishes it's purpose of creating a ultra low flow spray head that is independent of pressure gradients. It can also be seen that the best mode described in this disclosure is but one of theoretically many different ways to practice this invention and that spirit of this invention is captured in the disclosure heretofore observed in combination with the full breadth of the claims.

What is claimed is:

1. An Unitary low flow water dispersion device whereby a uniform amount of fluid flow is dispersed creating a wetted area said flow being independent of differentiations of pressure in the fluid supplied to said device comprising;

an inlet portion adapted to be received into the interior portion of said fluid supply means through external gripping means circumscribed thereabout, having an internal cylindrical core communicating with said fluid flow from said fluid supply means, an elastomeric control valve inextricably contained therein said cylindrical core to receive said fluid flow where said valve has an entrance aperture and a cylindrical emission slot whose size varies in geometric relations with presence of said fluid under said pressure differentiations and an exit aperture whose size does not vary in relation to presence of said fluid under said pressure, a dispersement section directly appurtenant to said inlet portion having an entrance in fluid communication with said exit aperture where said entrance promotes transition from said exit aperture preserving fluid velocity emanating from said control valve, a dispersion chamber, a pattern shaping means, a departure plane and a focal concussion point and whereby said dispersion chamber is defined by two angularly displaced sides equidistant to centerline of said entrance extending outwardly, said pattern shaping means is a radiusly defined slope, said slope being located at a distance furtherestmost from said entrance while allowing for said focal concussion point of the fluid to be tangentially related to said radiusly defined slope whereby said radiusly defined slope is terminated with said departure plane, said departure plane has a curvature concavitally related about said entrance, said departure place protruding contiguous to said radiusly defined slope.

2. An Unitary low flow water dispersion device as in claim 1 whereby said radiusly defined slope is terminated with said departure plane, said departure plane protruding outwardly perpendicular to said entrance whereby said radiusly defined slope is terminated with said departure plane, said departure place protruding contiguous to said radiusly defined slope outwardly perpendicular to said entrance.

* * * * *